United States Patent [19]

Sakamaki et al.

[11] 4,315,719

[45] Feb. 16, 1982

[54] NON-LUBRICATED ROTARY PUMP WITH DISCHARGE THROUGH END HEADS

[75] Inventors: Hiroshi Sakamaki, Utsunomiya; Toshiyuki Maeda, Ageo; Fumihiro Ushijima, Toyata; Tadashi Saitou, Toyota, all of Japan

[73] Assignees: Nippon Piston Ring Co., Ltd., Tokyo; Toyota Jidosha Kogyo Kabushiki Kaisha, Aichi, both of Japan

[21] Appl. No.: 84,206

[22] Filed: Oct. 12, 1979

[30] Foreign Application Priority Data

Oct. 26, 1978 [JP] Japan ..... 53-147624[U]

[51] Int. Cl.[3] ..... F04C 27/00

[52] U.S. Cl. ..... 418/15; 418/133; 418/156; 137/854

[58] Field of Search ..... 418/15, 131, 133, 153, 418/156, 132; 137/854

[56] References Cited

U.S. PATENT DOCUMENTS

| | | | |
|---|---|---|---|
| 2,437,791 | 3/1948 | Roth et al. | 418/131 |
| 3,311,064 | 3/1967 | Eichele et al. | 418/133 |
| 3,941,149 | 3/1976 | Mittleman | 137/854 |
| 3,964,844 | 6/1976 | Whitmore et al. | 418/133 |

*Primary Examiner*—John J. Vrablik

*Attorney, Agent, or Firm*—Sughrue, Mion, Zinn, Macpeak and Seas

[57] ABSTRACT

A rotary fluid pump of a non-lubrication type having a pump cavity formed within a cylindrical stator housing and a pair of recessed end head assembles. A drive shaft is eccentrically journalled in the end heads with a rotor mounted thereon with vanes slidably disposed in radial grooves in the rotor. A pair of sealing plates disposed between the ends of the stator having and the end heads divide the pump cavity into a pair of end chambers and an intermediate rotor chamber. An outlet port provides fluid communication between the rotor chamber and a discharge hole in one of the end chambers so that fluid passage for discharge to the atmosphere is provided through the rotor chamber, outlet port, end chamber and discharge hole.

9 Claims, 6 Drawing Figures

NON-LUBRICATED ROTARY PUMP WITH DISCHARGE THROUGH END HEADS

BACKGROUND OF THE INVENTION

The invention relates to a rotary fluid pump of a non-lubrication type in which fluid intake, compression and discharge operations are carried out by movement of vanes accompanied by the rotation of a rotor. More specifically, the present invention relates to a type thereof wherein a pair of resilient sealing plates are sealingly disposed each between a main body of a stator housing and an end head to defined end chambers each between the sealing plate and a recessed portion of the end head.

Vanes made of carbon materials or synthetic resin materials have previously been known in rotary fluid pumps of the non-lubrication type. Wear particles released from the vanes are generated by the sliding contact between the radially outer end portions of the vanes and an inner peripheral surface of the main body such as the sealing plates. In pumps of this type, provision must be made to prevent wear caused by the released wear particles. Conventionally, almost all of these wear particles are discharged to the outside of the pump through an outlet port formed in the main body. Wear particles released from the vanes are also generated by sliding contact between the end faces of the vanes and the inner surfaces of the sealing plates. Conventionally, such wear particles are discharged outside of the pump through at least one discharge port formed in the lower portion of the end chambers as disclosed in Japanese Utility Model Application No. 8823/1978. However, these techniques are not considered to be sufficient for totally discharging wear particles.

Further, in case such rotary fluid pump is utilized on an automobile, when the automobile travels over a rough road, dust or water may enter the pump through the discharge port thereby giving rise to additional wear between the inner surface of the sealing plates and the side faces of the rotor further degrading pumping efficiency. If the discharge port is closed to prevent dust and water from entering the pump, wear particles cannot then be discharged to the outside of the pump. Further, grease may flow from around the pump's bearings upon the closure of the discharge port. The above-noted difficulties need to be solved in order to provide improved pump performance and lifetime.

SUMMARY OF THE INVENTION

It is therefore an object of the present invention to overcome the above-mentioned drawbacks and to provide an improved non-lubrication type rotary fluid pump.

Another object of this invention is to provide such a rotary fluid pump capable of effectively discharging a large amount of wear particles to the outside of the pump while yet preventing dust or water from entering the pump through a wear particle discharge port.

These and other objects are attained in accordance with the invention by providing an outlet port in fluid communication with at least one end chamber and at least one discharge port in fluid communication with the end chamber. Wear particles released from the vanes and generated at every portion are positively discharged by the outlet fluid passing through the end chambers. In this case, the particle-laden fluid stream provides outlet pressure which prevents dust and/or water from entering the pump.

Further according to several embodiments of the invention, elastic valves of mushroom shape are disposed in the fluid passage so as to further prevent dust and/or water from entering the pump as well as to serve as silencers. Such elastic valve are disclosed in U.S. Patent Application Ser. No. 39,413 filed May 15, 1979, which is commonly assigned herewith.

These and other objects of this invention will become apparent from the description of the drawings and the preferred embodiments which follow.

DETAILED DESCRIPTION OF THE PREFERRED EMBODIMENTS

Figure 1:
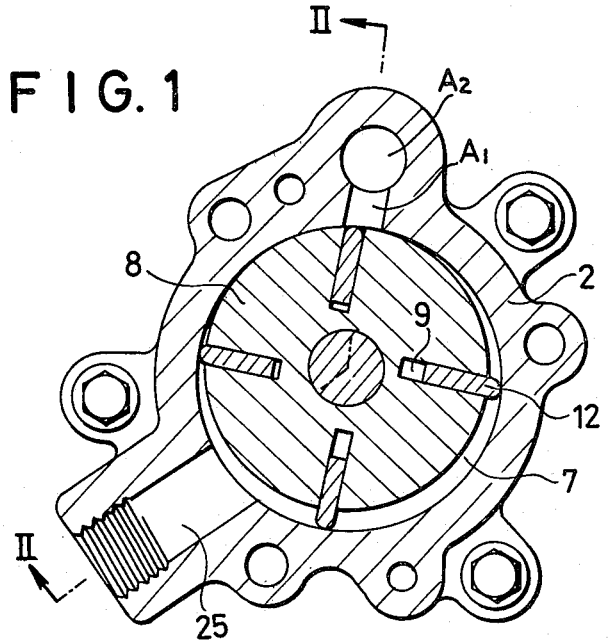
FIG. 1 is a transverse cross-sectional view of a rotary fluid pump according to a first embodiment of the invention.
Figure 2:
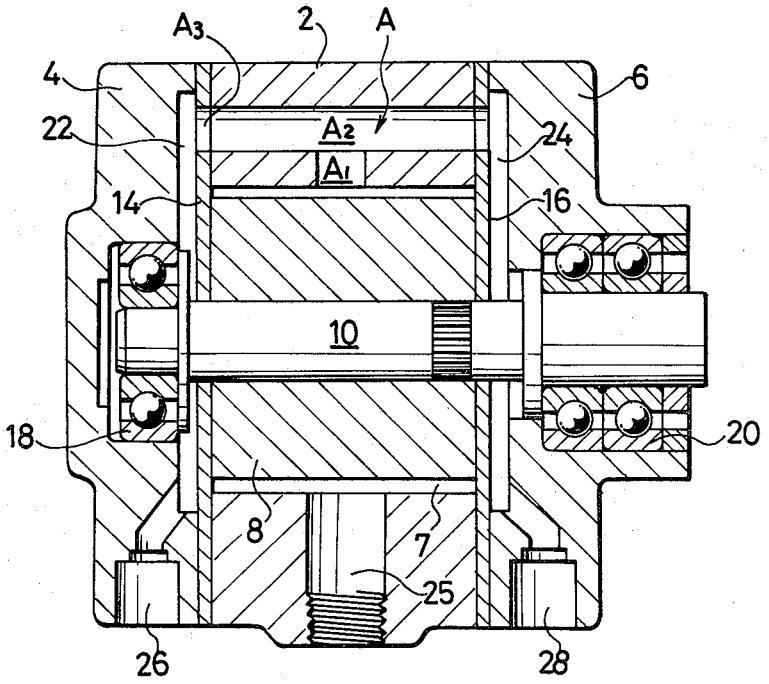
FIG. 2 is a cross-sectional view taken along the line II—II of FIG. 1.

A first embodiment according to the invention is shown in FIGS. 1 and 2 wherein a rotor 8 is eccentrically mounted on a drive shaft 10 in a rotor chamber 7 defined by a stator housing 2 and end heads 4 and 6. The drive shaft 10 is rotatable by bearings 18, 20 each disposed in end heads 4, 6, respectively. A plurality of grooves 9 are radially formed as shown in FIG. 1 to receive an equal number of vanes 12 therein. The vanes 12 slide radially outwardly in the grooves by centrifugal force and fluid pressure due to the rotation of the rotor 8. Side end surfaces of the vanes 12 are in surface contact with sealing plates 14, 16, each secured between the stator housing 2 and end heads 4 and 6. The radially outermost end surface of the vane 12 is in surface contact with an inner peripheral surface of the stator housing 2. As a result, the steps of fluid intake, compression and discharge are accomplished in a well-known manner.

Each end head is formed with a recess at the interior thereof to provide end chambers 22 and 24 formed by the end heads and the counterfacing side plates 14 and 16. Reference numeral 25 designates a fluid inlet port formed in the stator housing 2.

According to the present invention, an outlet port is in fluid communication with end chambers 22, 24, which in turn, is in fluid communication with outlet holes 26, 28, respectively, to thereby discharge fluid in the rotor chamber 7 to the outside of the pump through end chambers 22, 24. With this arrangement, wear particles produced by sliding contact between the radially outermost ends of the vanes 12 and an inner peripheral surface of the stator housing 2 are discharged through the outlet port formed in the stator housing and all wear particles are discharged to the outside by the fluid stream passing through the end chambers 22, 24. Further, the outlet pressure prevents dust and water from entering the pump device. This is in marked contrast to the conventional pump in which wear particles entering the end chambers are discharged through one or more discharge openings formed in the lower portion thereof merely utilizing gravity action on the wear particles.

According to the first embodiment, an outlet port A has a bore $A_2$ formed in the stator housing 2 extending in a direction substantially parallel with an axial direction of the pump device, a radial bore $A_1$ formed in the stator housing and extending radially at the axially center portion of the pump device, and a pair of openings $A_3$ formed in the respective sealing plates 14, 16 and in alignment with the axial bore $A_2$. The outlet port provides fluid communication between the rotor chamber 7 and end chambers 22, 24. At the lower portion of the end chambers 22, 24, outlet holes 26, 28 are formed in the respective end heads 4, 6. The outlet holes provide fluid communication between the end chambers 22, 24 and the atmosphere.

Thus, fluid passage is provided in this manner in the pump device. That is, the fluid supplied in the rotor chamber 7 through the inlet port 25 is discharged to the atmosphere through outlet port A, end chambers 22, 24 and outlet holes 26, 28. Therefore, wear particles generated by sliding contact between the radially outermost faces of the vanes 12 and the inner surface of the housing 2 and between inner surfaces of the sealing plates 14, 16 and side end faces of the vanes 12 are discharged to the outside through the end chambers 22, 24. Further, the wear particle-laden fluid stream provides outlet pressure which prevents dust and/or water from entering the pump device through outlet holes 26, 28.

Second to fifth embodiments of the invention are shown in FIGS. 3 to 6 wherein like parts and components are designated by the same reference numbers and characters as those shown in the first embodiment.

Figure 3:
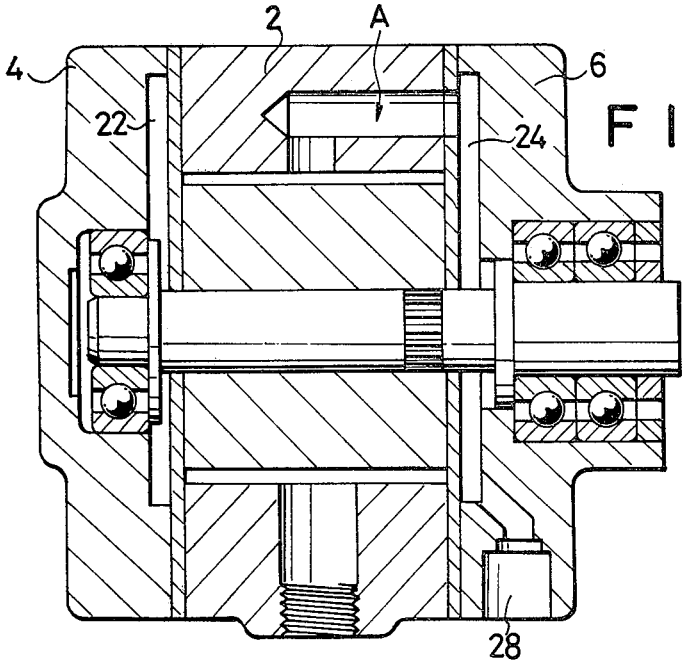
FIG. 3 is a cross-sectional view of a rotary fluid pump according to a second embodiment of the invention.

The second embodiment is shown in FIG. 3 wherein an outlet port A is in fluid communication with one end chamber 24 (front side of the pump device) and a single outlet hole 28 is formed in the front side of the end head 6. Of course, the outlet port A can be in fluid communication with the other end chamber 22 and the single outlet hole can be formed in the end head 4, instead of in fluid communication through the end chamber 24.

Figure 4:
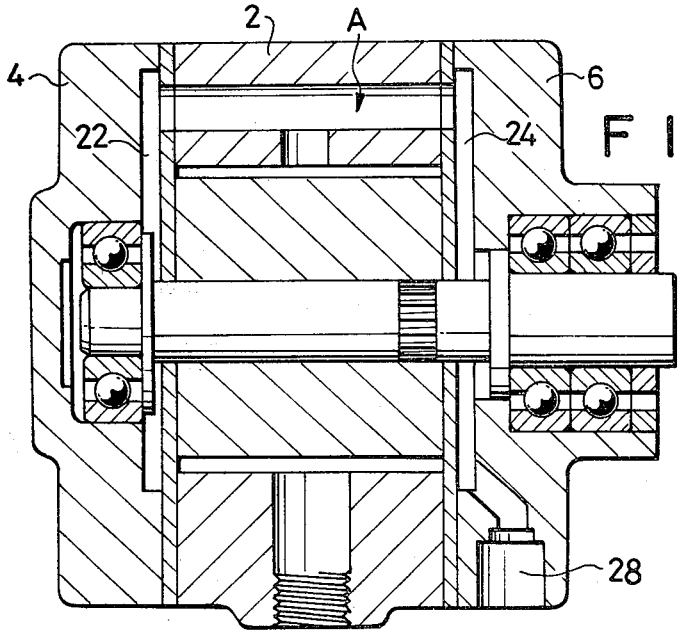
FIG. 4 is a cross-sectional view of a rotary fluid pump according to a third embodiment of the invention.

The third embodiment is shown in FIG. 4, wherein an outlet port A is formed to provide fluid communication with both end chambers 22, 24. However, a single outlet hole 28 is formed in the front side of the end head 6. In this embodiment, outlet pressure is applied to both end chambers 22, 24 to provide pressure balance between end chambers. Further, uniform pressure is provided between the end chambers and the rotor chamber. However, the outlet hole is singularly formed in only the front side end head 6. With this arrangement, wear particles can only very slightly pass into the end chambers through holes formed in the sealing plates for insertion of the drive shaft 10 in comparison with the second embodiment.

Incidentally, if such pump is used as a vacuum pump, the presence of two outlet holes causes no problem. However, if such pump is used as a compressor, problems may arise in terms of piping. In such a case, end chambers are connected together to provide fluid communication therebetween and the outlet hole is formed in the stator housing so as to avoid the piping problem.

Figure 5:
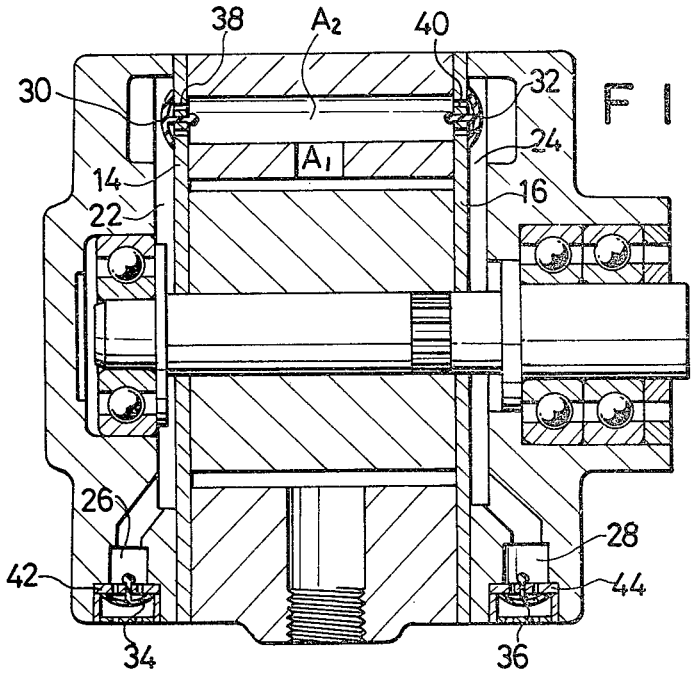
FIG. 5 is a cross-sectional view of a rotary fluid pump according to a fourth embodiment of the invention.

A fourth embodiment of this invention is shown in FIG. 5 wherein elastic valves of parasol or mushroom shape are disposed at outlet port A and outlet holes 26, 28 in order to further prevent dust and water from entering the pump device through the outlet holes 26, 28 as well as to absorb noise due to fluid discharge therethrough. Such elastic valves are disclosed in U.S. patent application Ser. No. 39,413 filed May 15, 1979, which is commonly assigned herewith.

Elastic valves 30, 32 each include a parasol-shaped member, a shaft extending from the central portion of the parasol-shaped member and a locking part formed at the free end of the shaft. The locking part is larger in diameter than the shaft. Each of the elastic valves 30, 32 is fitted in a corresponding one of a plurality of holes 38, 40 formed in the sealing plates 14, 16, respectively. These holes 38, 40 are obviously in alignment with the axial hole $A_2$. Each of the elastic valves are fitted so as to position the parasol-shaped member in the respective end chambers.

Further, elastic valves 34, 36 are disposed in the outlet holes 26, 28 by means of valve plates 42, 44 each having a plurality of holes. Each of the shaft portions of the elastic valves 34, 36 is fitted in holes of valve plates 42, 44 so as to position the parasol-shaped portion at downstream of the valve plates.

Thus, the elastic valves further prevent dust and/or water from entering the pump device particularly, in the rotor chamber 7. Further, fluid pressure (air pressure) from the rotor chamber 7 pushes against the parasol-shaped members, thus venting out into the atmosphere. In this case, as air impinges on the inner surfaces of the parasol-shaped members, the direction of the flow of air changes abruptly and the air expands abruptly and contracts repeatedly to thereby act as silencers whereby noise due to air flow is absorbed.

Figure 6:
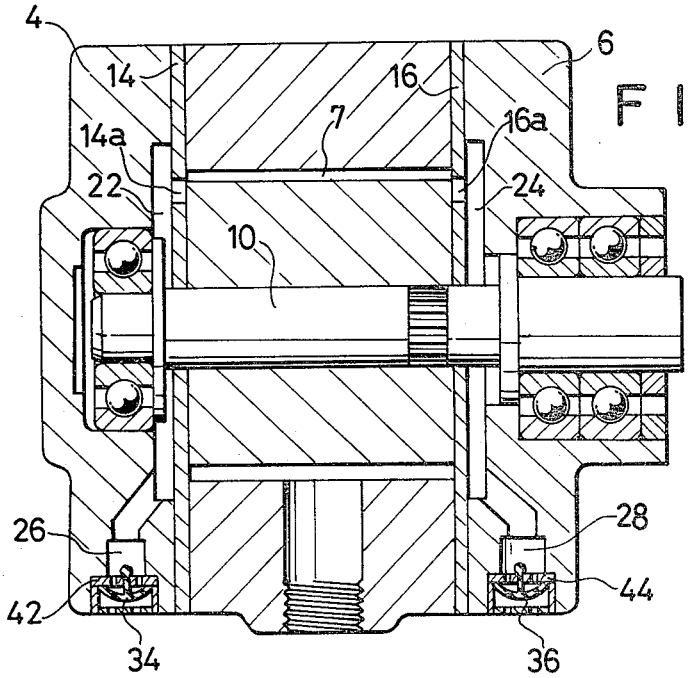
FIG. 6 is a cross-sectional view of a rotary fluid pump according to a fifth embodiment of the invention.

A fifth embodiment according to this invention is shown in FIG. 6 wherein an outlet port has openings **14*a* and 16*a* formed in the sealing plates 14, 16, respectively. Further, elastic valves 34, 36 are disposed in outlet holes 26, 28 formed in the end heads 4, 6, respectively, by means of valve plates 42, 44**, respectively.

According to this embodiment, the outlet port, that is the openings **14*a*, 16*a* provide fluid communication directly between the rotor chamber 7 and end chamber 22, 24. Therefore, wear particles produced in the rotor chamber 7 are introduced into the end chambers 22, 24 through openings 14*a*, 16*a* and a clearance space between the drive shaft 10 and the holes formed in the sealing plates 14, 16 for inserting the drive shaft therethrough. The wear particles are discharged to the outside through the elastic valves 42, 44 by the fluid stream passing through the end chambers 22, 24 and the outlet holes 26, 28**.

In view of the foregoing, according to the present invention, the outlet port and the outlet hole communicate with each other through the end chamber to provide fluid passage therethrough so that wear particles generated in the rotor chamber and/or end chamber are caught by the fluid and are discharged to the outside. Further, the particle-laden fluid stream provides outlet pressure which prevents dust and water from entering the pump device.

Further, according to the present invention, elastic parasol-shaped valves are disposed in the fluid passage to further prevent dust and/or water from entering the pump device as well as to provide noise absorption.

While the invention has been described in detail and with reference to specific embodiments thereof, it will be apparent to one skilled in the art that various changes and modifications can be made therein without departing from the spirit and scope thereof.

What is claimed is:

1. A rotary fluid pump of a non-lubrication type comprising: a stator housing having a generally cylindrical cavity extending therethrough, a pair of fixed recessed end heads assembled at opposite ends of the housing to form a pump cavity with said stator housing, a drive shaft journalled in said end heads and extending eccentrically into the interior of the pump cavity, a rotor mounted on said drive shaft within the pump cavity, a pair of resilient sealing plates individually disposed between ends of said stator housing and said end heads and dividing said pump cavity into a pair of end chambers defined by said recessed end heads and said plates and an intermediate rotor chamber defined by said plates, a plurality of vanes slidably disposed in an equal plurality of grooves radially formed in the rotor, outlet port means in said housing for completing a fluid communication path between said rotor chamber and at least one discharge hole formed at a lower portion of at least one of said end chambers whereby fluid passage, under the outlet pressure of the pump, is provided through said rotor chamber, said outlet port means, said end chamber and said discharge hole to discharge fluid, containing wear particles from the vanes, to the atmosphere.

2. The rotary fluid pump of claim 1, wherein said outlet port means includes at least one opening formed in at least one of said sealing plates, said opening providing fluid communication between at least one of said end chambers and said rotor chamber.

3. The rotary fluid pump of claim 1, wherein said outlet port means is formed by a radial hole formed in said stator housing extending along the radial direction of said rotor, an axial hole formed in said stator housing and extending substantially in parallel with said drive shaft, and at least one opening formed in at least one of said sealing plates, one end of said radial hole being opened to said rotor chamber and the other end thereof being connected to said axial hole, and said opening being in alignment with said axial hole.

4. The rotary fluid pump of claim 3, wherein both ends of said axial hole are connected to openings formed in said sealing plates whereby said rotor chamber is in fluid communication with said end chambers through said openings.

5. The rotary fluid pump of claim 1, wherein said at least one discharge hole is formed at the lower portion of one of said end heads, said discharge hole being directed vertically and providing fluid communication between said at least one of end chambers and the atmosphere.

6. The rotary fluid pump of claim 5, wherein said discharge hole is formed at respective lower portions of said end heads.

7. The rotary fluid pump of claim 3, further comprising elastic parasol-shaped valves disposed at said openings formed in said sealing plates, said openings being formed of a plurality of smaller holes, and said elastic valves being fitted with one of said smaller holes.

8. The rotary fluid pump of claim 7, wherein said elastic parasol-shaped valve comprises a parasol-shaped member, a shaft portion and a locking portion whose diameter is larger than that of the shaft portion, said parasol-shaped portion being positioned in said end chambers and said shaft portion being fitted with said one of said small holes.

9. The rotary fluid pump of either of claims 1 or 7, further comprising elastic parasol-shaped valves disposed at said discharge holes formed in said end heads.

* * * * *